US009775403B2

(12) United States Patent
Bernhard et al.

(10) Patent No.: US 9,775,403 B2
(45) Date of Patent: Oct. 3, 2017

(54) SOLE STRUCTURE FOR A RUNNING SHOE

(71) Applicant: On Clouds GmbH, Heiden (CH)

(72) Inventors: Olivier Bernhard, Heiden (CH); Ilmarin Heitz, Zürich (CH)

(73) Assignee: ON CLOUDS GMBH, Heiden (CH)

( * ) Notice: Subject to any disclaimer, the term of this patent is extended or adjusted under 35 U.S.C. 154(b) by 664 days.

(21) Appl. No.: 13/839,306

(22) Filed: Mar. 15, 2013

(65) Prior Publication Data

US 2014/0259748 A1 Sep. 18, 2014

(51) Int. Cl.

| | |
|---|---|
| ***A43B 13/18*** | (2006.01) |
| ***A43B 1/10*** | (2006.01) |
| ***A43B 13/16*** | (2006.01) |

(52) U.S. Cl.

CPC ..... *A43B 13/181* (2013.01); *A43B 13/16* (2013.01)

(58) Field of Classification Search

CPC ..... A43B 13/181; A43B 13/187; A43B 13/18; A43B 13/185; A43B 13/141; A43B 13/127

USPC ..... 36/29, 30 R, 28, 35 R, 103, 13 B, 3 B, 36/102, 27

See application file for complete search history.

(56) References Cited

U.S. PATENT DOCUMENTS

| | | | | |
|---|---|---|---|---|
| 3,834,046 | A | 9/1974 | Fowler | |
| 4,130,947 | A | 12/1978 | Denu | |
| 5,461,800 | A * | 10/1995 | Luthi | A43B 13/206 36/114 |
| 5,946,824 | A | 9/1999 | Tighe et al. | |
| 6,516,539 | B2 * | 2/2003 | Nishiwaki et al. | 36/28 |
| 7,152,343 | B2 * | 12/2006 | Whatley | A43B 13/20 36/29 |
| 7,877,899 | B2 | 2/2011 | Nishiwaki et al. | |
| 7,941,941 | B2 | 5/2011 | Hazenberg et al. | |
| 8,196,315 | B2 * | 6/2012 | Ryu | 36/3 R |
| 8,365,445 | B2 * | 2/2013 | Sink | 36/103 |
| 9,015,962 | B2 | 4/2015 | Boudreau et al. | |
| 2004/0154189 | A1 | 8/2004 | Wang | |
| 2004/0194343 | A1 | 10/2004 | Kim | |
| 2011/0016749 | A1 | 1/2011 | Callahan et al. | |

OTHER PUBLICATIONS

Office Action mailed May 28, 2015; in U.S. Appl. No. 13/839,004.
Notice of References Cited mailed May 28, 2015; in U.S. Appl. No. 13/839,004.

* cited by examiner

*Primary Examiner* — Jameson Collier
(74) *Attorney, Agent, or Firm* — Pauley Erickson & Kottis

(57) ABSTRACT

A sole structure for a running shoe is presented having an outsole and a midsole. The sole structure includes a plurality of hollow elements, which are closed off in each case by front flanks and rear flanks, and have spaced-apart upper inner surfaces and lower inner surfaces, that forces to which the hollow elements are subjected when the runner is running are absorbed by these hollow elements in each case with deformation, with the spacing between their inner surfaces decreasing in the process. The upper inner surfaces of the hollow elements are formed on the underside of the midsole, that the lower inner surfaces of the hollow elements are formed on the upper side of the outsole, which is fastened on the underside of the midsole in each case in front of, and behind, the hollow elements, the front flanks and the rear flanks likewise forming part of the outsole.

20 Claims, 3 Drawing Sheets

SOLE STRUCTURE FOR A RUNNING SHOE

TECHNICAL FIELD

The present invention relates to a sole structure for a running shoe, having an outsole and a midsole, it being the case that the sole structure comprises a plurality of hollow elements, which are closed off in each case by front flanks and rear flanks, as seen in the longitudinal direction of the sole structure, but are open laterally, and have spaced-apart upper inner surfaces and lower inner surfaces, that forces to which the hollow elements are subjected when the runner is running are absorbed by these hollow elements in each case by elastic deformation, with the spacing between their inner surfaces decreasing in the process, and possibly by horizontal displacement of their inner surfaces in relation to one another, and that the hollow elements can be deformed to such a pronounced extent that their upper and lower inner surfaces come into contact with one another, and that this contact prevents horizontal displacement of said inner surfaces in relation to one another.

PRIOR ART

WO03/103430 A1 discloses such a sole structure. The outsole, which comprises the hollow elements, allows a large amount of deformation even in the horizontal direction. The sole structure can thus yield to the horizontal forces caused by the forward movement when the runner is running. On the other hand, there is effective avoidance of the so-called floating effect, usually associated with horizontal deformation, as a result of the collapse of the hollow elements with the inner surfaces thereof in contact with one another. In the case of the known sole structure, in each case a plurality of hollow elements are arranged one behind the other, and one beside the other, in the forefoot region, and in the heel region, such that they can be deformed individually.

In WO03/103430 A1, the outsole, which comprises the hollow elements, is fastened on the underside of the midsole, it being the case that the midsole does not make any contribution, at least not one worthy of particular mention, to the deformation explained above.

GENERAL DESCRIPTION OF THE INVENTION

It is an object of the invention to improve the known sole structure further and also to render it capable, inter alia, of being produced more cost-effectively.

This object is achieved according to the invention by a sole structure as claimed in claim 1. Accordingly, the sole structure according to the invention is defined in that the upper inner surfaces of the hollow elements are formed on the underside of the midsole, in that the lower inner surfaces of the hollow elements are formed on the upper side of the outsole, which is fastened on the underside of the midsole in each case in front of, and behind, the hollow elements, the front flanks and rear flanks likewise forming part of the outsole, and in that, for elastic deformation of the hollow elements until the upper inner surfaces and lower inner surfaces thereof are in contact with one another, it is mainly only the outsole which is deformed.

The invention also uses the midsole for the purpose of forming the hollow elements. However, it is still the outsole, which comes into contact with the ground, which is the part which is deformed in the desired manner. The novel feature here of the hollow elements being joined together from two parts means that there is more freedom for designing the same. Limitations which arise, for example, from the formation of single-part hollow elements are no longer an issue.

Advantageous embodiments and developments of the sole structure according to the invention are given in the dependent claims.

Therefore, it may be provided, for example, that, for elastic deformation of the hollow elements until the upper inner surfaces and lower inner surfaces thereof are in contact with one another, it is mainly only the front flanks and rear flanks of the hollow elements which are deformed.

Furthermore, it may be provided that the midsole is designed to project downward in each case in the region of the hollow elements, i.e. in the region of the upper hollow-element inner surfaces, which are formed on the midsole. It is thus possible for the outsole, upon deformation of the hollow elements, to position itself to better effect by way of the lower inner surfaces, which are formed on it, against the upper inner surfaces. This avoids convexities of the outsole on collapsed hollow elements, at which premature wear can occur as a result of increased abrasion.

The upper and lower inner surfaces of the hollow elements are each preferably provided with transverse ribs which, with the inner surfaces in contact with one another, engage one inside the other and thus help to prevent horizontal displacement of the inner surfaces in relation to one another. It is further preferable here for the transverse ribs of hollow elements in the front part of the sole structure (forefoot region) to be smaller, and more numerous, than the transverse ribs of the hollow element in the rear part of the sole structure (heel region).

As an alternative, or in addition, to the presence of ribs, it is possible for at least one of the upper hollow-element inner surfaces, which are formed on the midsole, to be of rough design at least over part of its surface area and be provided with an average roughness depth Rz of 250-500 μm. The roughness here may also be formed by stuck-on patterns or pressed-in latticework or grid formations. This design prevents the occurrence of squeaking, which may possibly arise if the upper and lower inner surfaces, when they come into contact with one another, still slide briefly one upon the other until their contact with one another prevents any further displacement.

The front flanks and rear flanks at least of one of the hollow elements may be of different thicknesses. In particular in the forefoot region, there is at least one hollow element present of which the front flank is thinner than the rear flank. In the heel region, there is at least one hollow element present of which the front flank is thicker than the rear flank. This design allows for the fact that, when the runner is running, he usually places the heel region on the ground and uses the forefoot region to push off from the ground. The horizontal component of the force which has to be absorbed is thus directed forward in the heel region and rearward in the forefoot region, as a result of which hollow elements in the heel region tend to deform in the rearward direction and those in the forefoot region tend to deform in the forward direction. In order that the inner surfaces of the hollow elements can position themselves against one another over the surface area, their rear flank, as seen in the deformation direction in each case, has to, as it were, fold up, this being aided by the relatively thin wall thickness thereof.

The cross section at least of one of the hollow elements can change in the transverse direction of the sole. It is thus possible, in particular, for the orientation of the flanks thereof to be adapted to the locally acting deformation forces.

The outer layer may be designed in more than one part, it being the case that the individual parts each help merely to form a plurality of hollow elements arranged one behind the other in the longitudinal direction of the sole. The outer layer, then, is made up of a number of parts which can be optimized in terms of positioning. In particular it is possible for transversely adjacent parts of the outer layer to help to form different numbers of hollow elements.

BRIEF DESCRIPTION OF THE DRAWINGS

An exemplary embodiment of the invention will be explained hereinbelow with reference to the drawing, in which.

WAYS OF IMPLEMENTING THE INVENTION

Figure 2:
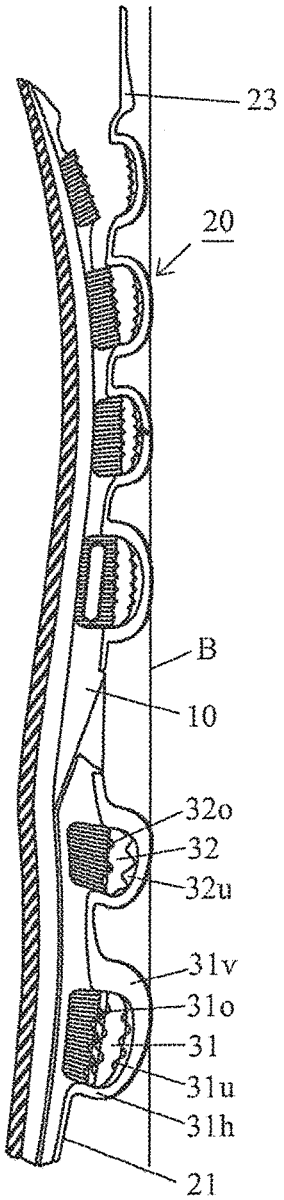
FIG. 2 shows a lateral-side view of the sole structure from FIG. 1.
Figure 3:
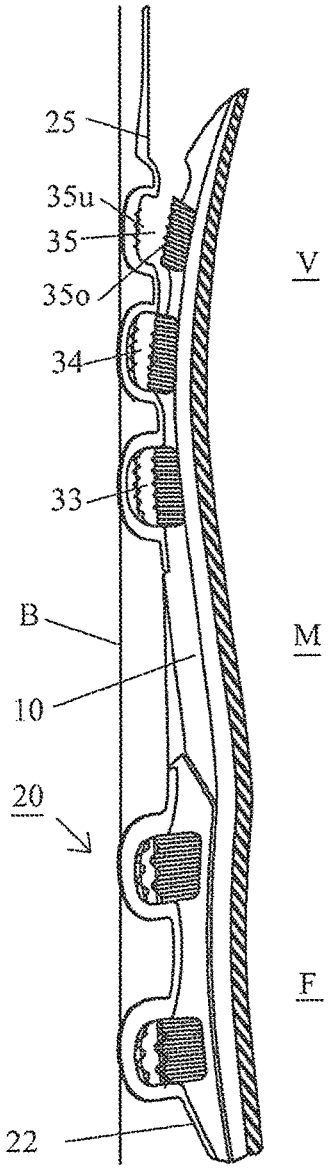
FIG. 3 shows a medial-side view of the sole structure from FIG. 1.
Figure 4:
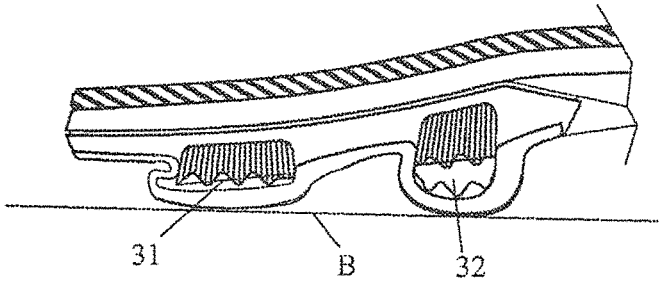
FIG. 4 shows a detail from FIG. 2 with one hollow element deformed.

The sole structure for a running shoe illustrated in the drawing is joined together from a midsole 10 and an outsole 20. The outsole 20, during use, is in contact with the ground, which is indicated in FIGS. 2-4 by a line designated B. The midsole 10, as its name suggests, is arranged between the outsole and the upper part of the shoe (not illustrated).

The midsole 10 is in one piece and thus extends over the heel region F, the midfoot region M and the forefoot region V of the sole structure. A possible example of a material to use for the midsole 10 is EVA with a Shore C hardness of 55. The thickness of the midsole 10 is greater in the heel region F and in the midfoot region M than in the forefoot region V.

The outsole 20 is in a number of parts and, in the present exemplary embodiment, comprises five parts, designated 21-25. A possible material to use for the outsole, or the parts thereof, is a rubbery, elastically deformable material, but one which is difficult to compress.

Each of the parts 21-25, together with the midsole 10 in each case, forms a plurality of hollow elements arranged one behind the other in the longitudinal direction of the sole structure. For example, the part 21 in the heel region F on the lateral side, together with the midsole 10, forms the hollow elements 31 and 32, and the part 25 in the forefoot region V on the medial side, together with the midsole 10, forms the hollow elements 33, 34 and 35. There are no hollow elements present in the midfoot region M, although it would likewise be possible for them to be found here.

The hollow elements are closed off in each case by front flanks and rear flanks, as seen in the longitudinal direction of the sole structure, and have spaced-apart upper inner surfaces and lower inner surfaces. The flanks and the lower inner surfaces are formed in each case on the outsole 20. The upper inner surfaces, in contrast, are formed in each case on the midsole 10. On the hollow element 31, the front flank is designated 31*v* and the rear flank is designated 31*h*. The upper inner surface of said hollow element 31 is designated 31*o* and the lower inner surface is designated 31*u*.

The outsole 20 and/or the parts 21-25 thereof is/are fastened on the midsole 10, in each case in front of, and behind, the hollow elements, for example by adhesive bonding. It is merely so that the outsole parts 21 and 25 can be distinguished to better effect from the midsole 10 that these parts have been illustrated in FIGS. 2 and 3 as projecting forward from the midsole in the forefoot region V.

Under the forces to which they are subjected when the runner is running, the hollow elements can be deformed with the vertical spacing between their upper and lower inner surfaces decreasing in the process and mostly also by horizontal displacement of their inner surfaces in relation to one another. However it is, at least mainly, only the outsole 20 which contributes to said deformation of the hollow elements and, on said outsole, in particular the front and rear flanks of the hollow elements. In contrast, the midsole 10 is, for all practical purposes, stiff and dimensionally stable in the region of the hollow elements when subjected to the aforementioned forces.

The compliance of the hollow elements, furthermore, is such that, under the forces to which the hollow elements are subjected when the runner is running, with elastic damping of these forces, they can be deformed in each case individually, i.e. possibly one after the other in the case of a rolling action over the sole structure, to such a pronounced extent that their upper and lower inner surfaces come into contact with one another. This contact, first of all, puts a stop to any vertical deformation which has taken place, but also prevents possibly further horizontal displacement of the inner surfaces of the hollow elements in relation to one another, or of the respectively lower inner surface against the upper inner surface, which is fixed in place on the midsole. FIG. 4 shows a detail from FIG. 2 having the hollow elements 31 and 32, the hollow element 31 being deformed in a typical manner with horizontal displacement of the lower inner surface in relation to the upper inner surfaces.

It should also be noted, in respect of this deformation state, that the upper and the lower inner surfaces of the hollow elements butt against one another in each case over the surface area, and that, in the case of at least some individual hollow elements, the respectively rear flanks thereof, as seen in the deformation and/or displacement direction, are folded up in an approximately s-shaped manner. This avoids local bulging of the outsole, at which repeated abrasion could take place. This is made possible by the midsole projecting some way outward in the region of the hollow elements in each case, and by the folded, rear flanks, as seen in the displacement direction, being somewhat thicker in each case than the front flanks, as seen in the displacement direction. This applies in each case to the hollow elements in the heel region A, such as the hollow elements 31 and 32, and also to the respectively rearmost hollow elements in the forefoot region C, such as the hollow element 33. As far as the rest of the hollow elements are concerned, a difference in thickness between the front and rear flanks thereof can be dispensed with or can be provided in the converse formation. Of course, the hollow elements have to be arranged with sufficient horizontal spacing between them in order for the horizontal deformation explained above to be possible and for them not to impede one another therein.

As can be seen in FIGS. 2 and 3, the hollow elements in the heel region F are higher than those in the forefoot region V. This means that the damping in the heel region F is higher than in the forefoot region B, where this damping is not required in the same way.

As can likewise be seen in FIGS. 2 and 3, the upper and lower inner surfaces of the hollow elements are each provided with transverse ribs. With the inner surfaces in contact with one another, these transverse ribs engage one inside the other and help to prevent horizontal displacement of the inner surfaces in relation to one another. In FIG. 2, transverse ribs in the hollow element 32 are designated 32*o* and 32*u* and, in FIG. 3, transverse ribs in the hollow element 35 are designated 35*o* and 35*u*. The transverse ribs of the hollow elements in the forefoot region V are smaller, and more numerous, than the transverse ribs of the hollow elements in the heel region F.

In a manner which has not been illustrated, the upper hollow-element inner surfaces, which are formed in each case on the midsole 10, are each of rough design at least over part of their surface area, the average roughness depth Rz being 250-500 μm. This makes it possible to prevent squeaking, which may possibly be caused by the upper and lower inner surfaces sliding one upon the other until they are arrested firmly with one another.

Figure 1:
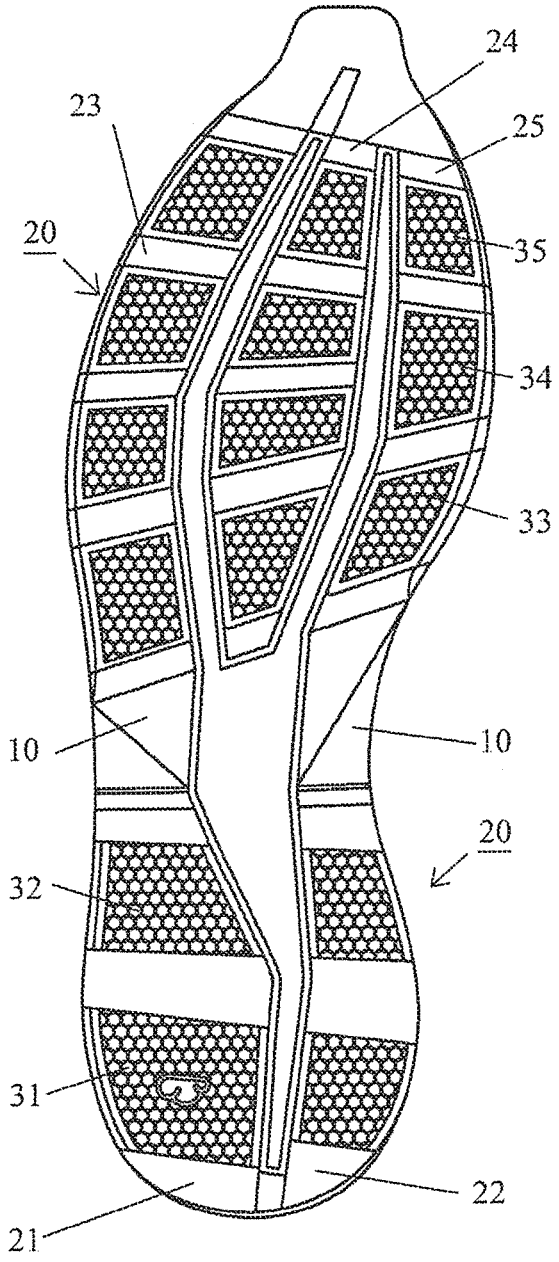
FIG. 1 shows a sole structure according to the invention having a plurality of hollow elements, with a view of its underside, which comes into contact with the ground.

As can be seen in the bottom view of FIG. 1, the hollow elements of the exemplary embodiment are of different sizes and are also of differing polygonal shapes, in which case their front flanks are not parallel to their rear flanks, this also applying to the lateral end surfaces thereof in relation to one another. This also means that the cross section of the hollow elements changes in the transverse direction of the sole. This makes it possible for the hollow elements to be designed in optimum fashion for the desired damping characteristics and to be arranged on the existing surface of the sole structure. In the exemplary embodiment, four hollow elements are present in two rows, each with two hollow elements one behind the other, in the heel region. In the forefoot region, eleven hollow elements are present in three rows, the lateral-side and the central rows each comprising four hollow elements and the medial row comprising three hollow elements.

LIST OF DESIGNATIONS

10 Midsole
20 Outsole
21-25 Parts of the outsole
31-35 Hollow elements
31*v* Front flank of the hollow element 31
31*h* The rear flank of the hollow element 31
31*o* Upper inner surface of the hollow element 31
31*u* Lower inner surface of the hollow element 31
32*o* Upper transverse ribs in the hollow element 32
32*u* Lower transverse ribs in the hollow element 32
35*o* Upper transverse ribs in the hollow element 35
35*u* Lower transverse ribs in the hollow element 35
F Heel region
M Midfoot region
V Forefoot region
B Ground

What is claimed is:

1. A sole structure for a running shoe, comprising:

an outsole and a midsole, the outsole and the midsole made from different types of material and the outsole and the midsole joined to one another, and a plurality of hollow elements, which are closed off in each case by a front flank and a rear flank, in the longitudinal direction of the sole structure, but are open laterally and each of the plurality of hollow elements have an upper inner surface and a lower inner surface, each upper inner surface and each lower inner surface of each of the plurality of hollow elements being spaced-apart and extending between each respective front flank and each respective rear flank, wherein each one of the plurality of hollow elements, which are configured to be subjected to forces generated during exercise when the runner is running, is configured to absorb the forces by being elastically deformed, such that the spacing between the respective upper inner surface and the respective lower inner surface decreases and horizontal displacement of the respective upper inner surface in relation to the respective lower inner surface occurs, and wherein each one of the plurality of hollow elements is configured to be capable, under the effect of said forces, of deforming to such a pronounced extent that the respective upper inner surface comes into contact with the respective lower inner surface, thereby preventing horizontal displacement of said upper inner surface in relation to said respective lower inner surface, wherein the upper inner surfaces of the plurality of hollow elements are formed on an underside of the midsole, wherein the lower inner surfaces of the plurality of hollow elements are formed on an upper side of the outsole, which is joined to the underside of the midsole in each case in front of, and behind, the plurality of hollow elements, the front flanks and the rear flanks likewise forming part of the outsole, and wherein only the outsole is deformed when the upper inner surfaces and the respective lower inner surfaces of the plurality of hollow elements are in contact with each other.

2. The sole as claimed in claim 1, wherein only the front flanks and rear flanks of the plurality of hollow elements are deformed when the upper inner surfaces and the respective lower inner surfaces are in contact with each other.

3. The sole as claimed in claim 1, wherein the midsole is designed to project downward in the region of each respective hollow element.

4. The sole as claimed in claim 1, wherein the upper inner surfaces and the lower inner surfaces of the plurality of hollow elements are each provided with transverse ribs which, when the inner surfaces are in contact with one another, engage with an adjacent transverse rib and thereby preventing horizontal displacement of the inner surfaces in relation to one another, wherein the sole has a forefoot region and a heel region, each with at least one of the plurality of hollow elements, and wherein the transverse ribs of the at least one hollow element in the forefoot region are smaller, and more numerous, than the transverse ribs of the at least one hollow element in the heel region.

5. The sole as claimed in claim 1, wherein at least one of the upper inner surfaces has an average roughness depth (Rz) of 250-500 μm at least over part of a surface area of the at least one upper inner surface.

6. The sole as claimed in claim 1, wherein the front flank and the rear flank of at least of one of the plurality of hollow elements have different thicknesses than one another.

7. The sole as claimed in claim 1, wherein the sole has a forefoot region and a heel region, each with at least one hollow element of the plurality of hollow elements, and wherein the front flank of the at least one hollow element in the forefoot region is thinner than the rear flank of said at least one hollow element, and wherein the front flank of the at least one hollow element in the heel region is thicker than the rear flank of said at least one hollow element.

8. The sole as claimed in claim 1, wherein a shape of the cross section of at least one of the plurality of hollow elements changes in the transverse direction of the sole.

9. The sole as claimed in claim 1, wherein the outsole is designed in more than one individual part, wherein the individual parts each help merely to form the plurality of hollow elements arranged one behind another in the longitudinal direction of the sole.

10. The sole as claimed in claim 9, wherein at least two transversely adjacent parts of the outsole are provided with a first number of hollow elements and a second number of hollow elements, and wherein the first number is different from the second number.

11. A sole structure for a running shoe comprising:

a midsole having an underside;

an outsole having an upper side coupled to the underside of the midsole, the outsole forming a plurality of front flanks and rear flanks, the underside of the midsole forming plurality of upper inner surfaces at respective locations corresponding to the plurality of the front flanks and rear flanks, and the outsole having a plurality of lower inner surfaces respectively corresponding to the plurality of upper inner surfaces, so that the plurality of front flanks, rear flanks, lower inner surfaces, and upper inner surfaces form a plurality of hollow elements, wherein the plurality of hollow elements is configured to elastically deform when the sole structure is subjected to forces generated during exercise, and wherein each hollow element is closed in the longitudinal direction of the sole structure by a respective front flank and a respective rear flank and each hollow element is open in the lateral direction of the sole structure; and wherein each hollow element has an undeformed configuration and a deformed configuration, wherein in the undeformed configuration, the upper inner surfaces are spaced apart from the respective lower inner surfaces, and wherein in the deformed configuration, the front flanks and rear flanks are deformed so as to cause the lower inner surfaces to come into contact with respective ones of the upper inner surfaces, and wherein in the deformed configuration, at least one of the plurality of hollow elements is configured to deform horizontally so that the lower inner surface and the upper inner surface of the at least one hollow element move relative to one another and once the lower inner surface and the upper inner surface are in contact, the upper inner surface and the lower inner surface are configured to prevent horizontal displacement relative to one another.

12. The sole structure according to claim 11, wherein the sole structure is configured such that the elastic deformation causes the upper inner surface and the respective lower inner surface of at least one hollow element to move closer to each other and causes horizontal displacement of the upper inner surface and the respective lower inner surface in relation to one another.

13. The sole structure according to claim 11, wherein the midsole is configured to project downward in the region of the plurality of hollow elements.

14. The sole structure according to claim 11, wherein the sole structure comprises a forefoot region and a heel region, each with at least one hollow element of the plurality of hollow elements;

wherein the upper inner surfaces and lower inner surfaces each further comprise transverse ribs, wherein each transverse rib is configured to engage an adjacent transverse rib, such that a peak of one rib is received in a valley of an adjacent rib, when the upper inner surface and the lower inner surface are in contact, so as to prevent horizontal displacement of the lower inner surface relative to the upper inner surface; and wherein the transverse ribs in the forefoot region are smaller and more numerous than the transverse ribs in the heel region.

15. The sole structure according to claim 11, wherein at least a portion of the surface area of at least one of the upper inner surfaces has an average roughness depth (Rz) between 250-500 μm.

16. The sole structure according to claim 11, wherein the front flank and the rear flank forming at least one of the plurality of hollow element have different thicknesses than one another.

17. The sole structure according to claim 11, wherein the sole structure comprises a forefoot region and a heel region, each with at least one hollow element of the plurality of hollow elements;

wherein the front flank forming the at least one hollow element in the forefoot region is thinner than the rear flank forming the at least one hollow element; and wherein the front flank forming the at least one hollow element in the heel region is thicker than the rear flank forming the at least one hollow element.

18. The sole structure according to claim 11, wherein a shape of the cross section of at least one hollow element changes in the transverse direction of the sole structure.

19. The sole structure according to claim 11, wherein the outsole is comprised of a plurality of transversely adjacent parts, wherein the parts form the plurality of hollow elements arranged one behind another in the longitudinal direction of the sole structure.

20. The sole structure according to claim 19, wherein a first transversely adjacent part of the plurality of transversely adjacent parts comprises a first number of hollow elements and a second transversely adjacent part of the plurality of transversely adjacent parts comprises a second number of hollow elements, the first number being different than the second number.

* * * * *